US005572183A

United States Patent [19]

Sweeney

[11] Patent Number: 5,572,183

[45] Date of Patent: Nov. 5, 1996

[54] LASER LIGHT FIRE EVACUATION SYSTEM

[76] Inventor: Gary L. Sweeney, 10693 Silverbrook Dr., Cincinnati, Ohio 45240

[21] Appl. No.: 373,652

[22] Filed: Jan. 17, 1995

[51] Int. Cl.[6] ..... G08B 5/00

[52] U.S. Cl. ..... 340/332; 340/691; 362/227; 362/259

[58] Field of Search ..... 340/691, 332; 362/153, 233, 241, 245, 247, 259, 307, 800, 227; 250/330

[56] References Cited

U.S. PATENT DOCUMENTS

| | | | |
|---|---|---|---|
| 3,335,285 | 8/1967 | Gally, Jr., et al. . | |
| 3,820,897 | 6/1974 | Roess . | |
| 3,858,043 | 12/1974 | Sick et al. . | |
| 3,969,720 | 7/1976 | Nishiuo | 340/332 |
| 4,200,251 | 4/1980 | Borjesson et al. | 250/330 |
| 4,347,499 | 8/1982 | Burkman et al. | 340/332 |
| 4,489,308 | 12/1984 | Logan et al. | 340/691 |
| 4,531,114 | 7/1985 | Topol et al. | 340/691 |
| 4,719,360 | 1/1988 | Kontaini et al. . | |
| 4,801,928 | 1/1989 | Minter . | |
| 4,893,005 | 1/1990 | Stiebel . | |
| 4,903,894 | 2/1990 | Pellinen et al. . | |
| 5,130,909 | 7/1992 | Gross | 362/183 |
| 5,140,301 | 8/1992 | Watanabe | 340/332 |
| 5,452,188 | 9/1995 | Green et al. | 362/74 |

*Primary Examiner*—Jeffery Hofsass
*Assistant Examiner*—Nina Tong
*Attorney, Agent, or Firm*—Frost & Jacobs

[57] ABSTRACT

A laser light fire evacuation system, and a method for its use, is provided including a source of laser light in the visible spectrum which is directed into multiple vertical columns of light extending from the ceiling to the floor of a hallway or corridor, in which the multiple columns are sequenced from left-to-right or from right-to-left during a fire to appropriately direct persons to the nearest safe exit. Each column of laser light is nearly invisible when the smoke density in the air is at a low level, however, as the smoke density increases, the laser light beam will increase in perceived intensity and consistency. In one embodiment, the laser light source is directed toward a rotating mirror which redirects the light into a rotating beacon as the mirror rotates. Several fiber optic cables are located around the periphery of the rotating mirror and intercept the light beam, thereby having laser light directed down each of the fiber optic cables, in sequence. The fiber optic cables are installed above the ceiling of a hallway or corridor and terminate in several locations along the ceiling of that corridor or hallway. As laser light is sequentially directed down each of these fiber optic cables, it will produce a sequencing pattern of laser light columns that each extend from the ceiling to the floor along that corridor or hallway. The beam rotator can be turned in either the clockwise or counter-clockwise direction to reverse the sequence of the light columns. Another embodiment uses adjustable mirrors to redirect the direction of the laser light beam. A third embodiment uses electrical cables and laser diodes to individually created columns of sequenced laser light.

16 Claims, 6 Drawing Sheets

LASER LIGHT FIRE EVACUATION SYSTEM

TECHNICAL FIELD

The present invention relates generally to fire evacuation alarm systems and is particularly directed to a fire evacuation system of the type which uses sequenced beams of light to guide persons who are attempting to escape from the affected area. The invention is specifically disclosed as a fire evacuation system that uses multiple beams of laser light which are directed from the ceiling to the floor of a corridor, hallway, or other open area, and which appear to have greater intensity and consistency as the density of the smoke increases in the affected area.

BACKGROUND OF THE INVENTION

Fire evacuation systems have been used in the past to assist people attempting to exit a building during a fire by giving the appropriate directions toward a safe exit nearest to those persons. In a typical public building, a smoke detector can trigger an audible fire alarm which makes the occupants aware of a problem. As these people attempt to escape from the building, they typically look for EXIT signs which direct these people to stairwells or doors that lead to the outside, away from the building. Unfortunately, once smoke starts filling the area that people are attempting to move through, an EXIT sign at the end of a hallway or corridor can become difficult or impossible to see through moderately thick smoke. Such moderately thick smoke may still be breathable, however, if the person trying to escape from the building cannot determine which direction to go, that person may not be able to leave the building before being overcome by smoke inhalation.

An egress direction lighting system is disclosed in U.S. Pat. No. 4,801,928, by Minter. Minter discloses the use of a plurality of indicator lights that have the appearance of arrows pointing in the proper direction for egressing from an area of a building during a fire. These indicator lights are sequenced to additionally aid in directing the people into the proper egress direction. Unfortunately, as smoke becomes thicker in the affected area, the sequencing lights used in Minter become less visible, in a similar fashion to EXIT lights used in most public buildings. To be effective, the person attempting to escape from the building must be near enough to a display panel that contains the sequencing lights disclosed in Minter.

SUMMARY OF THE INVENTION

Accordingly, it is a primary object of the present invention to provide a fire evacuation system that indicates which direction a person is to move to escape from the affected area in which the directing light signals become more intense in brightness as the smoke in the area becomes thicker.

It is another object of the present invention to provide a fire evacuation system that uses visible laser light in sequenced columns that appear more intense and consistent as the smoke level increases in the area.

It is a further object of the present invention to provide a laser light fire evacuation system that emanates sequenced columns of visible light that are spaced along a corridor or hallway of a building such that at least two of the columns of light can be easily seen in a smoked-filled environment by a person attempting to escape the corridor or hallway, and as these at least two columns are sequenced, the person is directed in the correct direction to escape the building.

It is a yet further object of the present invention to provide a laser light fire evacuation system that emanates sequenced columns of visible light that are spaced along a corridor or hallway of a building such that a person attempting to escape the corridor or hallway is aided and directed along the entire path of the corridor or hallway, in the correct direction to escape the building.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, a laser light fire evacuation system is provided having a source of laser light in the visible spectrum which is directed into multiple vertical columns of light extending from the ceiling to the floor of a particular hallway or corridor, in which the multiple columns are sequenced from left-to-right or from right-to-left during a fire alarm to appropriately direct persons to the nearest safe exit. Each column of light consists of collimated laser light, and will be nearly invisible if the particulate matter or smoke density in the air is at a low level. However, as the particulate level or smoke density increases, the laser light beam will increase in intensity and consistency.

In one preferred embodiment, a laser light fire evacuation system is provided with a light beam rotator that includes a rotating mirror. A single laser light source is directed toward this rotating mirror, which then redirects the light in one of many directions as the mirror rotates. Several fiber optic cables are located around the periphery of the rotating mirror assembly such that the light beam intercepts the initial portion of the fiber optic cables, thereby directing laser light down each of the fiber optic cables, one at a time. The fiber optic cables are installed above the ceiling of a particular hallway or corridor such that they terminate in several various locations along the ceiling of that corridor or hallway. As laser light is sequentially directed down each of these fiber optic cables, it will produce a sequencing pattern of laser light columns that each extend from the ceiling to the floor along that corridor or hallway. The beam rotator can be turned in either the clockwise or counter-clockwise direction to reverse the sequence of the light columns.

In a second preferred embodiment, a laser light fire evacuation system includes a mechanical light beam rotator which has a single laser light source aimed at a rotating mirror. As the mirror rotates, it directs laser light in one of several directions at any given instant toward a plurality of fixed mirrors that redirect the laser light from the ceiling area toward the floor of a particular hallway or corridor.

The rotating mirror can be turned in either the clockwise or counter-clockwise direction, as in the above embodiment, to reverse the sequence of the light columns as they radiate light within the hallway or corridor.

In a third preferred embodiment, a laser light fire evacuation system is provided with an electronic control device which has several outputs that are each attached to an electrical cable. Each of the several electrical cables is run above the ceiling of a particular hallway or corridor to terminate in a shutter device. At each of these shutter locations is a laser diode that is continuously energized by the electronic control device. When smoke or a fire is detected, the shutter devices start to sequentially open to produce columns of laser light extending from the ceiling to the floor in the particular hallway or corridor. The shutters can be sequenced from left-to-right or from right-to-left depending upon which direction the laser light fire evacuation system has determined as the correct exiting direction for people in the affected area. In addition to the above, a small photodiode or other electronic light sensing element can be installed near each of the shutters to detect whether or not the shutters are properly operating during the alarm. If a shutter is stuck in its open position, then that particular column of light can be de-energized if it might create a situation where the laser light would be too bright to be viewed by the human eye for an extended period of time.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
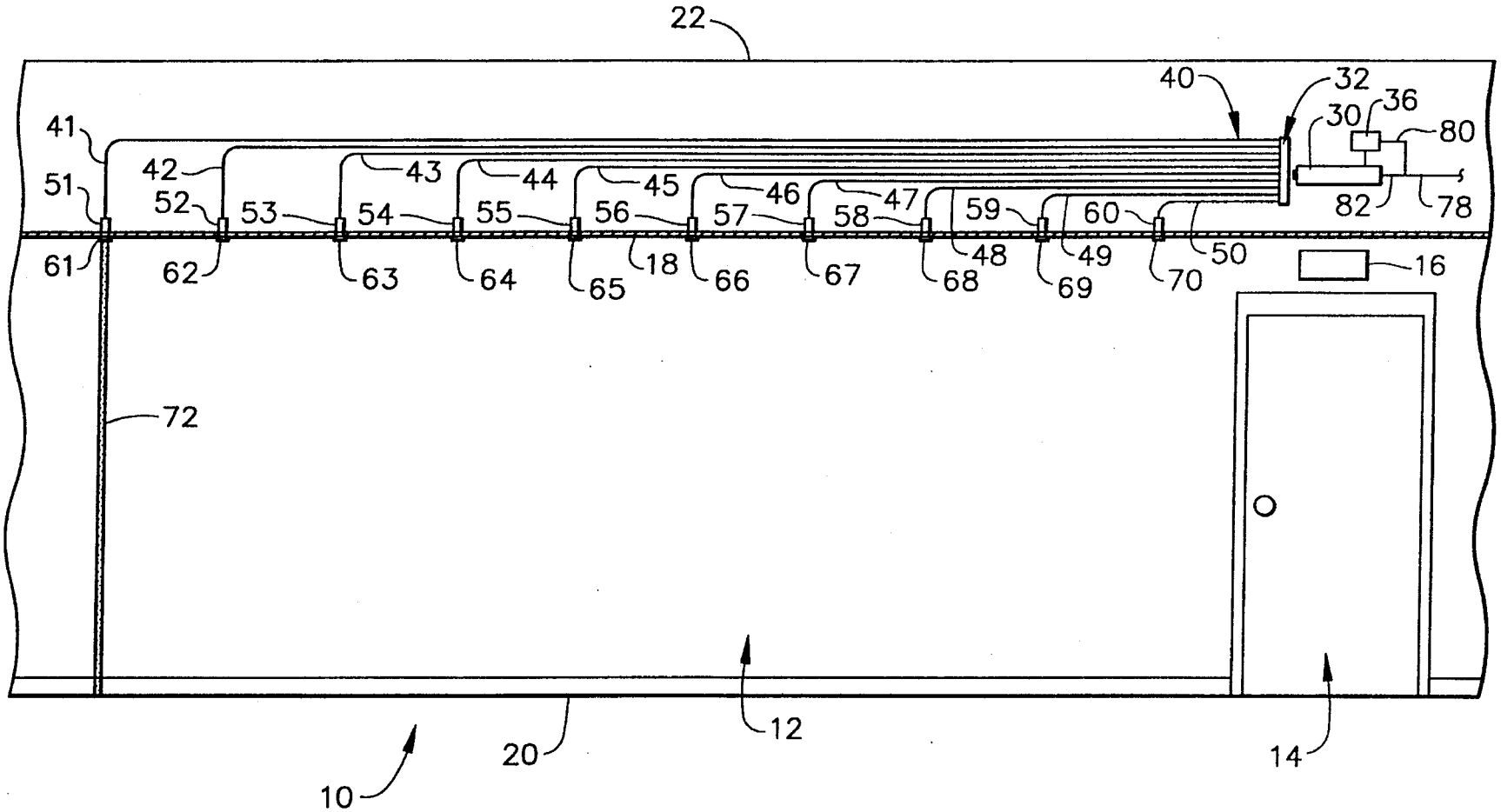
FIG. 1 is an elevational view of a hallway having a laser light fire evacuation system constructed in accordance with the principles of the present invention, and installed in its ceiling, in which fiber optic cables are used to carry the laser light.

Referring now to the drawings, FIG. 1 shows a laser light fire evacuation system, generally designated by the index numeral 10, as it would be installed in the ceiling spaces of a hallway or corridor 12. Laser light fire evacuation system 10 is intended to aid human beings in the safe and orderly evacuation of occupied portions of buildings, in particular for office buildings, assembly occupancies, schools, and other public buildings. Other types of buildings and occupancy situations will also benefit from the use of this system. As used herein and in the claims, the term "fire evacuation system" describes any type of emergency system (i.e., other than a "fire" system) in which smoke density, or the density of another type of particulate in the air, from any origin could require the evacuation of a building space.

Laser light fire evacuation system 10 is based upon the concept of laser light and its visual relationship to matter. Light waves consist of electromagnetic radiation which, even if vibrating at a visible frequency, remain essentially invisible until the light strikes solid matter. Most light sources, including incandescent and fluorescent light sources, generate light which radiates in all directions. Laser light is coherent, meaning that it radiates in a single direction or "beam". A beam of laser light will travel through air and will not be visible until the light strikes solid matter, at which point a "dot" appears on that solid matter. Because of this characteristic, laser light is commonly used with intrusion detection alarm systems.

If a laser beam passes through air containing particulate matter such as smoke, the light illuminates only those particles of matter that are within the actual area of the laser beam. Since the laser light is coherent (meaning that each photon of laser light is directed in the same direction as every other photon emanated by the laser light source), the laser light does not scatter in divergent directions from the main beam's direction unless a photon of laser light actually strikes a particle of matter. As the air in a particular hallway or corridor becomes filled with smoke, more and more of the laser light will strike solid matter (particulate matter in the air) and will be redirected away from the beam, i.e., toward other directions which may be intercepted by the eye of a human being. When this occurs, the laser light beam becomes visible to a person whose eye is not within the area at which the laser beam is aimed. As the smoke density becomes greater, more laser light strikes matter and is redirected away from the normal path of the beam, thereby making the perceived intensity of the laser beam greater to persons situated outside the path of the laser beam. The perceived intensity of the laser beam is dependent upon the density of particulate matter (smoke particles) being illuminated within the path of the laser beam, and also upon the power of the laser light source.

If multiple laser beams are directed into a particular corridor or hallway at regular intervals, and allowed to "flash" in a sequence, a directional effect can be obtained. This directional effect can be used to indicate the path to an exit in a building or other occupied space. The coherence of the laser beam makes it possible to provide the desired effect over long distances, such as corridors and hallways in large buildings having high ceilings, open malls and convention areas, tunnels, and other public installations. In an emergency situation after a fire alarm is sounded, the people who are attempting to escape from the affected building area may be confused if they do not precisely know where the building exits are. This situation would be particularly applicable to visitors in a public building. As smoke begins to accumulate in the particular hallway or corridor, the lighted Exit signs that are required by most building codes will tend to become less visible to the persons seeking the exits, because the smoke will tend to block the light traveling from the Exit sign to the person's eye. The laser light fire evacuation system 10 of the present invention actually becomes more visible as the smoke density increases in a particular hallway or corridor space, because more of the laser light is redirected as the smoke density increases. This feature can be of great assistance to sight-impaired people that would otherwise never be able to find a lighted Exit sign. As long as the multiple laser beams are spaced close enough to one another, a person would always be able to determine which direction to move to exit the building space by viewing the sequencing between adjacent laser beams.

The sequencing laser light can be energized at all times, if desired, and the laser beams would not be perceptible during normal operating conditions where there is no accumulation of smoke or other particulates in the air. Once smoke starts to accumulate, the laser beams begin to become perceptible by the human eye. Of course, an upper limit exists where the smoke density will obscure the perception even of the laser beams of the present invention. However, this smoke density probably would be such that human death and asphyxiation would also take place. As long as the atmosphere is somewhat breathable in the given corridor or hallway that is equipped with laser light fire evacuation system 10, the needed directions will reach the occupants at their point of need, rather than expecting them to find exit indicators at the ends of the corridor.

In FIG. 1, hallway or corridor 12 has a door exit 14 at one end with a lighted Exit indicator 16 above the door. The main components of laser light fire evacuation system 10 are mounted between the ceiling 18 and the overhead horizontal structure 22. During its operation, laser light fire evacuation system 10 sequentially shines a number of laser light beams from ceiling line 18 toward the floor 20, such as the laser beam 72. It will be understood that laser beam 72 could be directed in a non-vertical manner, for example, between two walls of a hallway or corridor near eye level in a horizontal direction. Laser beam 72 could even be directed in a diagonal manner, extending from ceiling line 18 near one wall to floor 20 near the opposite wall.

A laser light source control assembly 30 is mounted to a structurally sound surface above ceiling 18 of an egress way (hallway 12). During an emergency, laser light source 30 would be actuated by a smoke detector, such as one of the smoke detectors 86 and 88 (See FIG. 2), or some other type of alarm device. The output of laser light source 30 is directed into a beam distribution assembly 32, whereupon the laser beam is redirected into a fiber optic cable distribution system 40. Laser light source 30 can optionally be normally energized at all times if relatively long warm-up times are necessary for a particular manufacturer's device, or if it would extend its service life.

Figure 2:
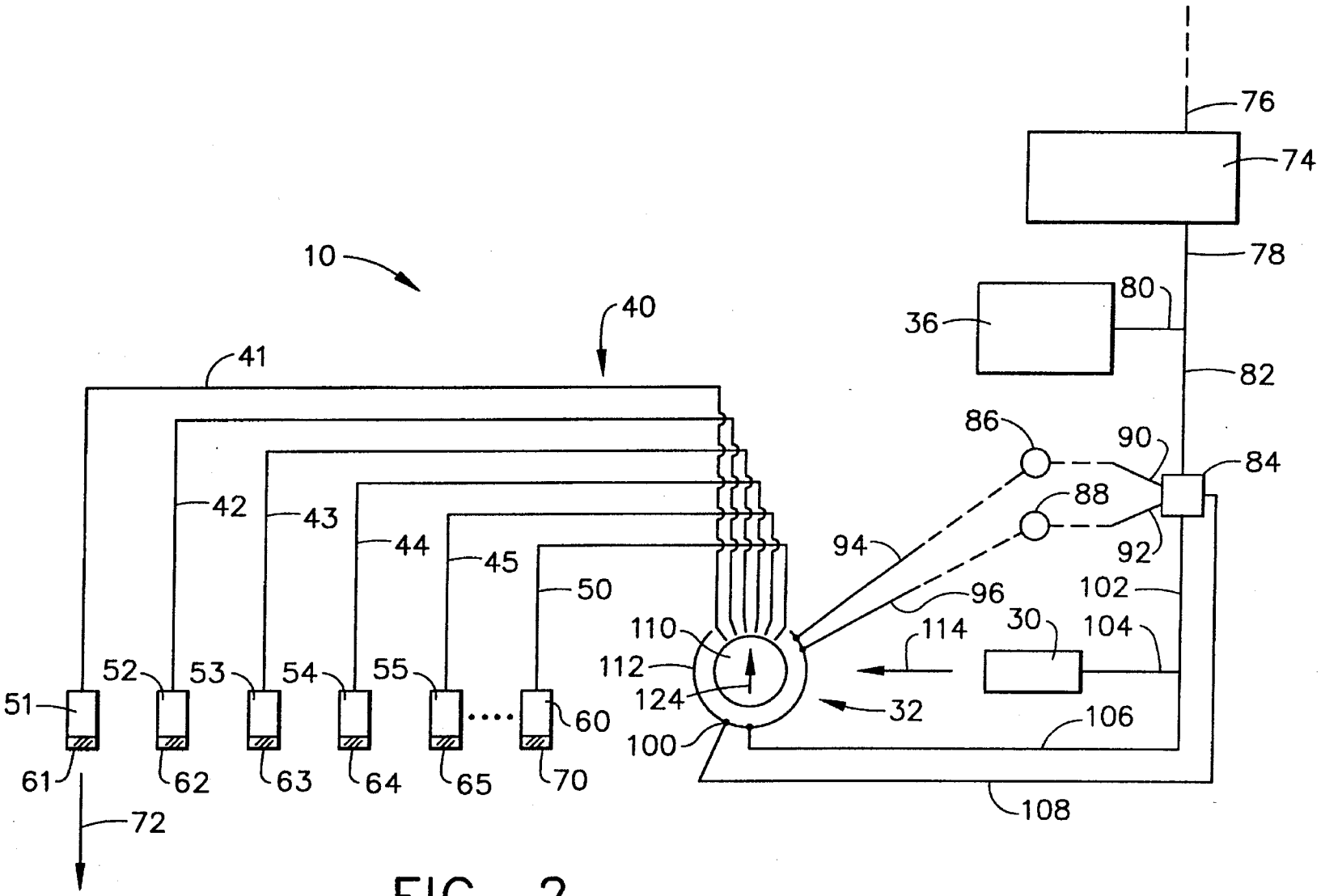
FIG. 2 is a diagrammatic view of the major components of the laser light fire evacuation system of FIG. 1.

To provide the proper electrical power to the laser light source and beam distribution assembly, a conventional DC power supply 74 is provided, having an incoming AC power line 76 (see FIG. 2). The output of DC power supply 74 is applied to a DC power cable 78, which is connected to a battery output cable 80 that is powered by a battery 36. In this manner, if the AC power coming into DC power supply 74 fails, the battery 36 will automatically continue to provide power to the system along DC power line 82.

An ON/OFF controller 84 is provided to actuate the beam distribution assembly 32. ON/OFF controller 84 essentially lies dormant until it receives a signal from either smoke detector 86 or smoke detector 88 along control cables 90 or 92. As smoke detector 86 is actuated, it indicates that beam distribution assembly 32 should rotate in a counter-clockwise manner, which would create a right-to-left sequence of laser light columns within hallway 12, indicating that a fire was probably in the right-hand portion of the hallway or corridor 12, and that people should move from the right portion of that corridor toward its left portion. In this situation, smoke detector 86 would also actuate a signal along control cable 94 to inform beam distribution assembly 32 that it is to rotate in a counter-clockwise manner. As that occurs, the output signal from the ON/OFF controller 84 is directed along power cable 102, power cable 104, and power cable 106 to the beam distribution assembly 32.

If, on the other hand, smoke detector 88 is actuated, it would command the beam distribution assembly 32 to rotate in a clockwise manner by providing a signal along control cable 96. At the same time, smoke detector 88 would activate a signal along control cable 92 to ON/OFF controller 84. When beam distribution assembly 32 rotates in a clockwise direction, it creates a left-to-right sequence of laser light columns within hallway or corridor 12. In this situation, the fire has been detected along the left portion of hallway or corridor 12 (as viewed in FIG. 1), and the people are being directed to exit to the right through door exit 14. If the direction of evacuation for a particular building space is always one-way, then beam distribution assembly 32 can be configured to operate in that one direction only.

An optional feature of laser light fire evacuation system 10 is use of an automatic shut-down sensor 100, which will detect whether or not beam distribution assembly 32 is properly rotating when energized. Such an automatic shut-down sensor would preferably be a photodiode, and it would be placed within the normal path of a laser beam as beam distribution assembly 32 rotates. If photodiode 100 does not detect any laser light within a certain time interval, one may assume that the beam distribution assembly 32 is not operating properly. When laser light is detected, a signal is sent by photodiode 100 along control cable 108 back to the ON/OFF controller 84. ON/OFF controller 84 would preferably include some type of timing device to determine whether or not it was periodically receiving signals from photodiode 100 within the proper time intervals. If ON/OFF controller 84 detects a problem, it may decide to shut down laser light fire evacuation system 10 if it appears that it would be dangerous not to do so.

Figure 3:
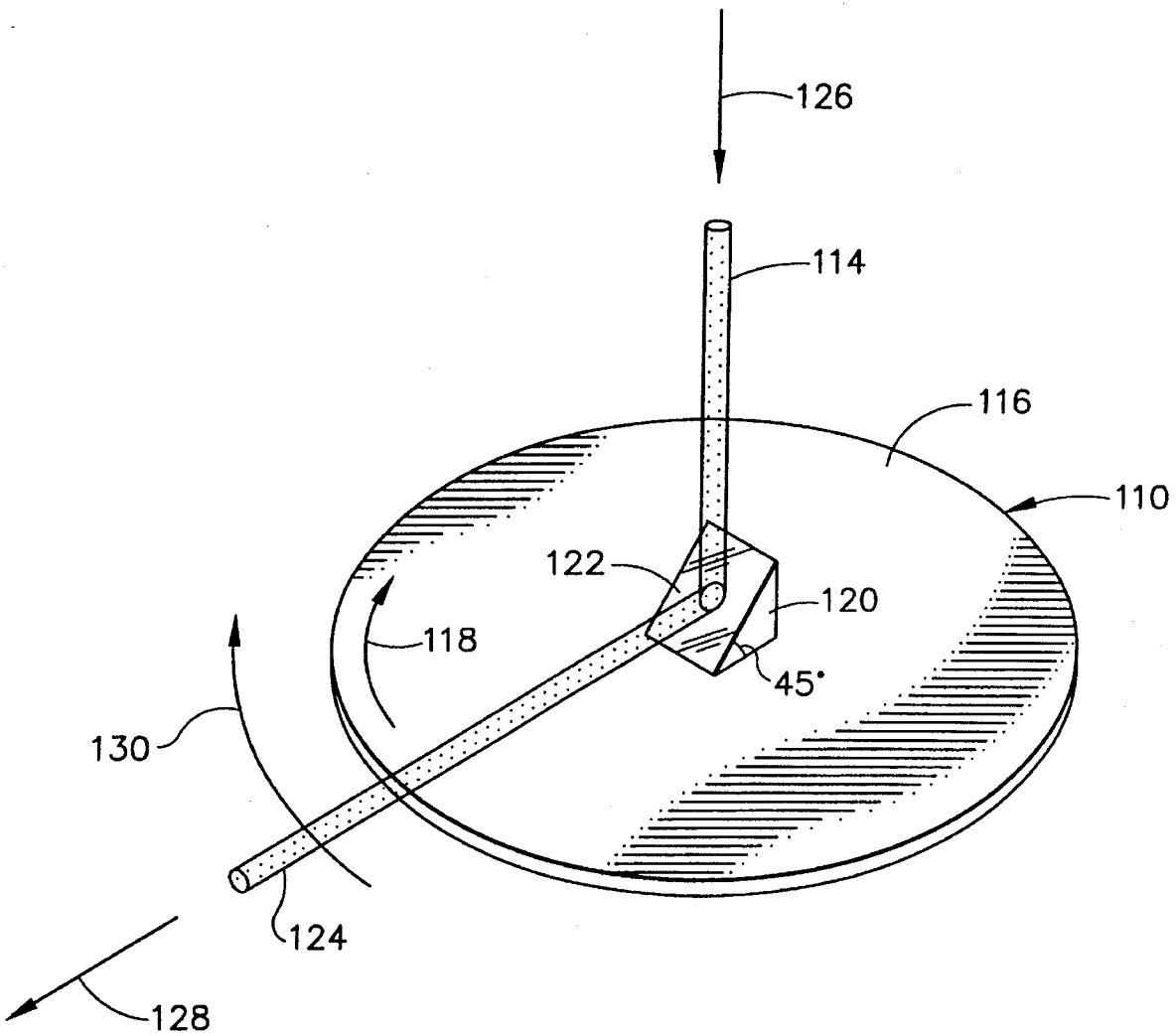
FIG. 3 is a perspective view of a light beam rotator which uses a mirror to redirect the direction of a laser beam, and is used in the laser light fire evacuation system of FIG. 1.

FIG. 3 depicts certain details of a beam rotator, generally designated by the index numeral 110. Laser light source 30 outputs a beam 114 that is directed into beam distribution assembly 32. As viewed in FIG. 3, laser output beam 114 has a direction designated by arrow 126 which is aimed at the center of a rotating table 116. Rotating table 116 is preferably motor driven (not shown), and turns in a clockwise direction of rotation 118 as viewed in FIG. 3. Beam 114 is directed to strike the angled mirror 122 of a triangular mounting 120, which is mounted at the center of rotating table 116. Triangular mounting 120 preferably has an angle of 45°, and thereby redirects beam 114 at a 90° angle to produce an output laser beam 124. Since the laser output beam 114 is stationary, it will strike the mirror 122 at essentially the same spot at all times, thereby producing a rotating output beam 124 that also rotates in a clockwise direction, generally depicted by the arrow 130. The instantaneous direction of output laser beam 124 is depicted by the arrow 128. By use of rotating table 116, the stationary laser output beam 114 is convened into a 360° rotating output beam 124.

As depicted diagrammatically in FIG. 2, laser output beam 124 is directed toward a beam shield 112, which blocks the laser light except at particular portions where the entrance of each of the multiple fiber optic cables is located. For example, as beam rotator 110 rotates in a clockwise direction, it will strike the end of a fiber optic cable 41, then in sequence, the end of fiber optic cables 42, 43, 44, 45, and all the way up through fiber optic cable 50. As the rotating output laser beam 124 strikes fiber optic cable 41, a packet of electromagnetic radiation travels down fiber optic cable 41 and terminates at the end of that fiber optic cable at a beam expander 51. Beam expander 51 is designed to expand the diameter of the laser light beam from its very small diameter while traveling inside the fiber optic cable 41, to at least one-half inch (13 mm) in diameter, and preferably to as large as two inches (51 mm) in diameter. After the electromagnetic radiation passes through beam expander 51, it then travels through a ceiling lens and shutter assembly 61. The ceiling lens is designed to keep dust out of the optics of the system, and the shutter is designed so that laser light only can travel from the ceiling 18 to the floor 20 of hallway 12 during a fire emergency, at which time the shutters will open.

In a laser light fire evacuation system 10 that has ten (10) fiber optic cables 41–50, there will be a corresponding ten (10) beam expanders 51–60, and ceiling lens and shutter assemblies 61–70. As beam distribution assembly 32 rotates in the clockwise direction, the arrangement of fiber optic cable distribution system 40 will provide multiple columns of light in sequence from left-to-right, and each of the columns of light (such as light column 72) will become more visible and intense as hallway or corridor 12 becomes more filled with smoke. If beam distribution assembly 32 rotates in the opposite, counter-clockwise direction, then the sequence of columns of laser light will be from right-to-left, as described above.

Laser light fire evacuation system 10 is designed with safety in mind, and with compatibility for most industrial and building codes. DC power supply 74 is preferably capable of operation with either 110 volts AC or 220 volts AC. The components that are mounted above ceiling 18 are preferably all enclosed in fire-resistant materials so as to afford at least the same fire ratings (in hours) as the wall or structure to which the components are attached. Alternatively, the components can be rated for the same fire ratings of the means of egress for which they serve. The laser light that is produced between ceiling 18 and floor 20 (such as laser light beam 72) is preferably designed to have a maximum intensity within the permissible exposure limits (P.E.L.) for humans. This can be accomplished either optically by beam density reductions, or by a timed exposure control. One method of implementing a timed exposure control is the use of automatic shut down sensor (or photodiode) 100 to detect a malfunction that may result in a prolonged beam operation, thereby aleenergizing ON/OFF controller 84 if necessary. ON/OFF controller 84 and beam distribution assembly 32 are preferably designed to be compatible with multiple smoke detector systems, building automation systems and other emergency systems. In addition, ON/OFF controller 84 and beam distribution assembly 32 can operate with single remote smoke detectors 86 and 88 as a full "stand alone" operation.

In either mode of operation, the sequential column of laser light beams flash in the direction of emergency egress. The duration of any individual beam flash in preferably less than one second per column, and, for example, as the light beam traveling through fiber optic cable 41 turns off, it is preferable that a light beam quickly begins to travel down fiber optic cable 42. To accomplish this desired goal, the ends of the various fiber optic cables need to be grouped adjacent to one another as closely as possible within beam distribution assembly 32 around the outer perimeter of rotating table 116. Since it is preferred that at least one column of light is perceived as visible at all times, a stepper motor or servo-drive should be used as the motor (not shown) to drive rotating table 116. It is preferred that the motor drive move at a particular rotating speed as rotating output laser beam 124 is directed into fiber optic cables 41–50, then the motor drive should greatly increase in speed throughout the remainder of its angular travel until rotating output laser beam 124 returns to one of the fiber optic cables of fiber optic cable distribution system 40. The more quickly this angular travel is accomplished while output laser beam 124 is striking beam shield 112 instead of one of the fiber optic cables, the better, since no laser light columns are illuminated in hallway 12 during this interval.

The preferred cycle rate of beam sequencing is approximately one-quarter second per pulse for any one fiber optic cable. For example, if laser light fire evacuation system 10 had eight fiber optic cables producing eight columns of sequenced light, it is preferred that there be eight flashes (one per fiber optic cable) over approximately a two (2) second time interval. This would give approximately one quarter second per pulse, and additionally provide very little time for the rotating table 116 to cycle back to the first fiber optic cable. As related above, beam expanders 51–60 preferably expand the laser light beam diameter to a minimum of one-half inch (13 mm). The preferred laser beam diameter at the output of the ceiling lens and shutter assemblies 61–70 is in the range of one inch (13 mm) to two inches (51 mm). The preferred distance between each individual ceiling lens and shutter assembly 61–70 to an adjacent similar ceiling lens and shutter assembly is in the range of two feet (61 cm) to four feet (122 cm) in distance along hallway or corridor 12.

It will be understood that the sequencing columns of laser light beams must be close enough to one another that a person standing in a smoke-filled corridor can see at least two of the beams so as to know which direction to move as the beams are being sequenced. In addition, in a very long corridor, more than one sequence of laser light columns would probably be desirable. The reason for this is that a system having more than ten or twelve columns of laser light would probably not repeat quickly enough (the cycle could require three to four seconds or more, depending upon cycle rate and time duration of each beam) and a person standing in a smoke-filled room would become disoriented waiting for the next sequence of laser light to flash near that person. Therefore, in such long corridors, more than one sequence of laser light beams would be preferred, such that the "first" laser light column would be immediately adjacent to the "last" laser light column of the adjacent system. In such long corridor situations, a maximum spread of 24–32 feet (731 cm–975 cm) should be maintained between leading flashes.

Laser light source 30 is preferably a helium-neon laser having at least a five (5) milliWatt output power capability. The laser light source should output a light frequency within the visible spectrum, and the light output should be randomly polarized. One preferred laser source that has been proven to be effective is manufactured by Melles Griot located in Irvine, California, and sold as model number #05LLR 851. This laser unit is powered by a 120 volt AC power source and produces visible light in the red spectrum, at 632.8 nm (nanometers). Since this particular model laser light source 30 is powered by 120 volts AC, the output from DC power supply 74 and battery unit 36 must be converted to AC by use of an inverter located at ON/OFF controller 84. If a DC powered laser light source 30 is used, then the inverter, of course, would not be required. This same electrical power arrangement is preferably used in other embodiments of laser light evacuation system, described hereinbelow.

Melles Griot produces similar laser light sources up to 100 milliWatts, which can be used in laser light fire evacuation system 10. The stepper or servo-drive motor is preferably a commercially available reversing or reversible motor. The beam expanders 51–60 are preferably commercially available units, sized according to beam density requirements in situations where the permissible exposure limits must be met for safe direct viewing by human eyes.

It will be understood that the output diameter of laser light source 30 and rotating output laser beam 124 should be of a beam diameter size to fully encompass the end of each fiber optic cable 41–50. In this manner, each fiber optic cable 41–50 will have its entire cable diameter covered by a light beam spot for at least an instant as rotating table 116 directs output laser beam 124 across the face of that particular fiber optic cable's input end. It may be preferable to have some overlap between the time that one column of light turns off and its adjacent column of light turns on. Using the fiber optic cable distribution system 40 of laser light fire evacuation system 10, it is inherent that a rotating output laser beam 124 having a small diameter spot would not provide any overlap, because output laser beam 124 would only be able to strike one fiber optic cable 41–50 at a time during a particular instant.

On the other hand, if the beam diameter were increased somewhat, either just before or just after the laser light path encounters triangular mirror 120, then there could be some overlap where laser light beam 124 would strike portions of more than one fiber optic cable in a particular instant. It would not be desirable for two adjacent laser light columns within a particular hallway or corridor 12 to both achieve full intensity at a given moment, for that would probably conrinse a person trying to egress from the effected area. Therefore, the laser beam diameter of the rotating output laser beam 124 should not be large enough to strike more than only a small portion of a second fiber optic cable end at one instant.

Figure 4:
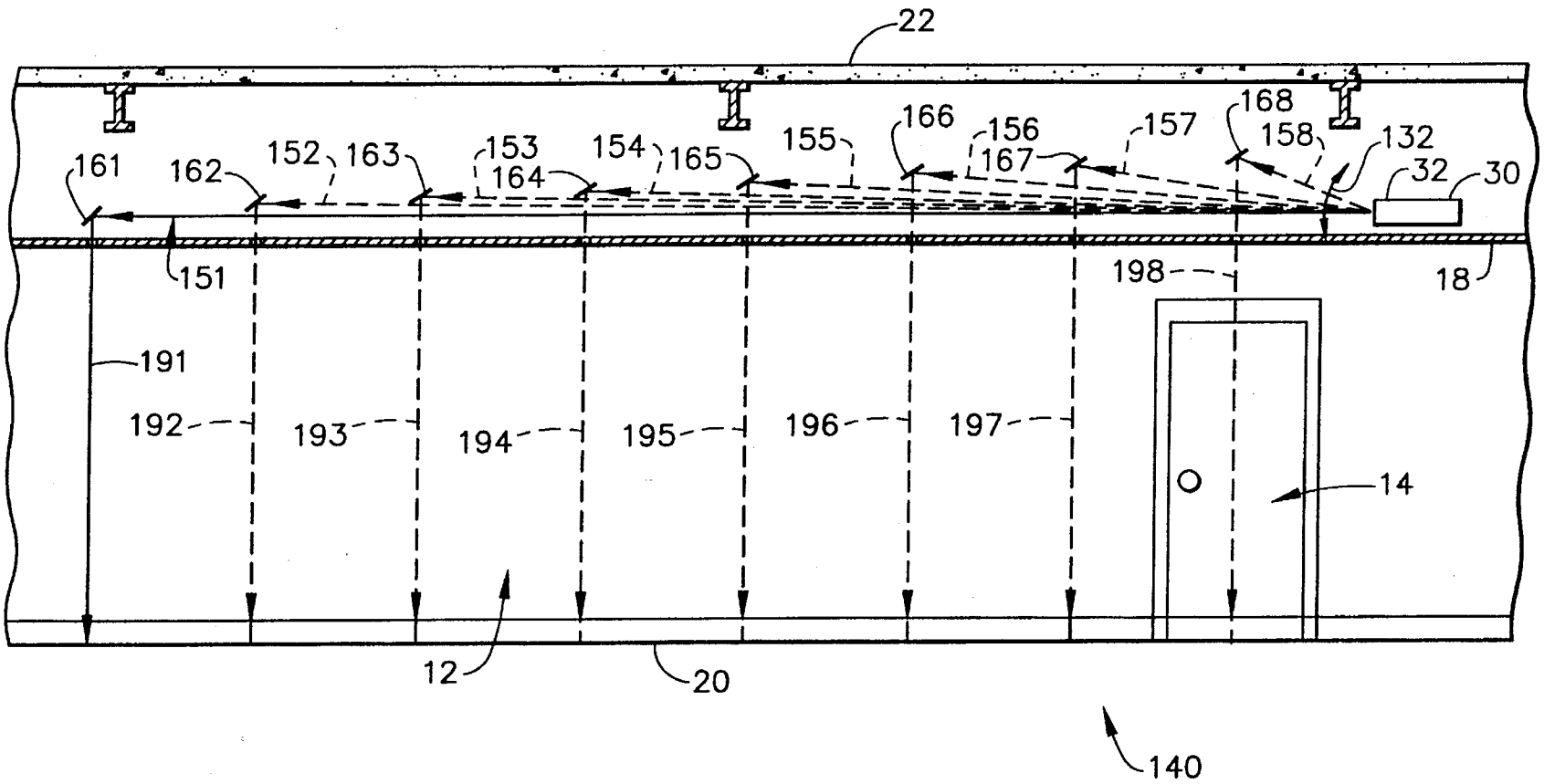
FIG. 4 is an elevational view of a hallway equipped with a laser light fire evacuation system in its ceiling spaces of the type that uses multiple mirrors to redirect laser light from the ceiling toward the floor of the hallway, and is constructed in accordance with the principles of the present invention.

A second preferred embodiment of laser light evacuation system is depicted in FIG. 4, and is generally designated by the index numeral 140. Laser light fire evacuation system 140 has many similarities to the first embodiment laser light fire evacuation system 10 related above. Both systems use a laser light source control assembly 30, and ON/OFF controller 84, smoke detectors 86 and 88, and a beam distribution assembly 32. One major difference is that laser light fire evacuation system 140 uses a beam expander 142 (see FIG. 5) to increase the diameter of the laser light beam from the small laser output beam 114 to a larger expanded output beam 144 before it enters beam distribution assembly 32. Beam expander 142 is preferably a model number 09LBX003, manufactured by Melles Griot, located in Irvine, Calif.

The most significant difference between the first embodiment laser light fire evacuation system 10 and the second embodiment 140 is the fact that laser light fire evacuation system 10 uses fiber optic cables to redirect the laser light paths until they reach the proper locations above ceiling 18, whereas laser light fire evacuation system 140 uses multiple mirror assemblies 161–168 to redirect the direction of the laser light beams. In effect, the second embodiment laser light fire evacuation system 140 is intended to be used in simple layout configurations and short distance spans having straight egress corridors or hallways that are essentially line-of-sight between the beam distribution assembly 32 and the ceiling 18. This is in direct contrast to laser light fire evacuation system 10 which can be used in complex layouts that include turns and bends in the egress path, or in longer corridors and areas in which the egress path may be altered due to tenant changes and furniture rearrangement.

Figure 5:
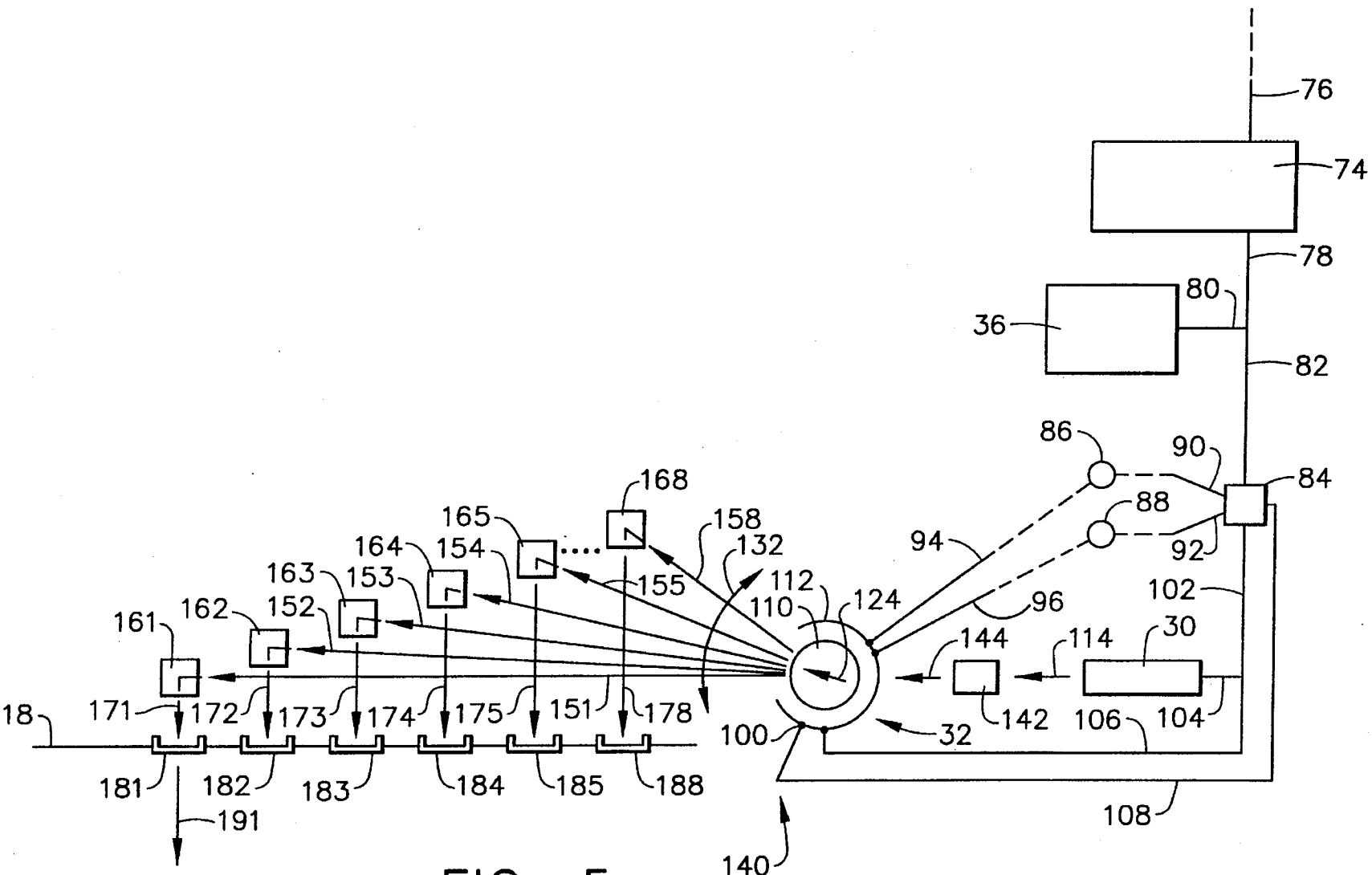
FIG. 5 is a diagrammatic view of the laser light fire evacuation system of FIG. 4.

FIGS. 4 and 5 describe laser light fire evacuation system 140 and how it is preferably installed in the area above a ceiling 18. The major control components and electrical wiring remain the same as in the laser light fire evacuation system 10. The laser light beam is expanded by beam expander 142 before it enters beam distribution assembly 32 so that the output beams leaving the rotating mirror 120 are larger in diameter than the laser output beam 114. It is preferred that the laser output beams 151–158 which exit through holes in beam shield 112 should be large enough that, after contacting mirrors 161–168, they will be large enough to directly be aimed from the ceiling 18 to the floor 20 in the hallway or corridor 12 without any further beam conditioning. The diameter of each of beams 151–158 is preferably at least one-half inch (13 mm) to one inch (25 mm) in diameter.

The mirrors 161–168 are preferably attached to an adjustable bracket (not shown) which allows each of the mirrors to be moved up, down, or sideways, and in addition, allows each mirror to have its angle of tilt adjusted until it is the correct position to redirect its incoming beam directly downward (in a vertical fashion). The second embodiment 140 inherently has little or no overlap time between adjacent laser light beams because the rotating output laser beam 124 only intercepts one of the mirrors 161–168 at a time, although portions of beam 124 may strike two of the mirrors at a given instant.

The spacing between mirrors 161–168 is preferably between two feet (61 cm) and four feet (122 cm) apart from one another, so that the spacing of laser light columns along corridor or hallway 12 is at the correct distance. As can be seen in FIG. 4, each of mirrors 161–168 will have to be adjusted for a slightly different tilt angle since the laser light of each of their incoming beams 161–168 is at a slightly different angle with respect to the horizontal. In this way, each of the beams, generally designated by the index numerals 171–178 can be directed vertically downward as they each leave mirrors 161–168. Beams 171–178 are directed through ceiling lenses 181–188, which act as dust covers between the hallway or corridor 12 and the upper ceiling area. The final output beam light paths that are emitted through ceiling lenses 181–188 are generally designated by the index numerals 191–198.

Depending upon the direction of rotating table 116 of beam rotator 110, the sequencing of light flashes within corridor 12 will be either left-to-right or right-to-left. In the illustrated embodiment depicted in FIGS. 4 and 5, if beam rotator 110 is traveling in a clockwise direction, then the light sequencing would be from left-to-right, and would be normally actuated by an alarm signal from remote smoke detector 88. On the other hand, if beam rotator 110 were traveling in a counter-clockwise direction (actuated by remote smoke detector 86), then the sequencing of beam flashes would be from right-to-left. This bi-directional aspect is indicated on the drawings by the arrows 132.

The general sequencing timing, spacing and beam diameters are preferably the same for second embodiment laser light fire evacuation system 140 as for the previously described laser light fire evacuation system 10, and for the same reasons. It will be understood, however, that if there is a bend in hallway or corridor 12 having a second embodiment laser light fire evacuation system 140 installed, then there should be a vertical beam of sequential laser light located directly at the bend in that corridor, with another adjacent beam on either side to make it easy for a person to decide which direction to move if they are located at that bend in the corridor.

In both laser light fire evacuation system 10 and laser light fire evacuation system 140 there is no electricity running throughout the ceiling space between ceiling 18 and horizontal ceiling structure 22. This means that each of these fire evacuation systems can be used in hazardous areas, if that is desirable for a particular installation. If the rotating motor (not shown) that provides the drive for rotating table 116 of beam rotator 110 is in an explosion proof housing, and if the power supply 74 and battery 36 are similarly in explosion proof housings, then the entire system can be installed in a hazardous area. This in contrast with a third preferred embodiment laser light fire evacuation system 200, depicted in FIG. 6, which uses electrical cables and signals to drive individual laser diodes that are located within the ceiling space between ceiling 18 and horizontal structure 22.

The third embodiment laser light fire evacuation system 200 has only a few similarities in its components as compared to the previously described embodiments. Fire evacuation laser light system 200 uses a conventional DC power supply 74 having an AC power line 76 and an output DC power cable 78, which is further connected to the output cable 80 of a battery 36. These lines are combined to provide a DC power line 82 which provides power to an ON/OFF controller 84. A further power cable 204 is directly connected to an electronic sequencer 202. The remote smoke detectors 86 and 88 operate in a similar fashion to those described hereinabove, and similarly are connected to control cables 90, 92, 94, and 96.

A common power cable 206 is connected to each laser diode, generally designated by the index numerals 211–216, in laser light fire evacuation system 200. Each laser diode 211–216 is preferably a part number 06DLL603, manufactured by Melles Griot, located in Irvine, Calif. Each laser diode 211–216 emits electromagnetic radiation within the visible light spectrum, preferably red. Each laser diode 211–216 has an individual power cable, designated by index numerals 221–226, which are each fed by common power cable 206.

Each laser diode 211–216 outputs a laser light beam that follows a path 231–236 (see FIG. 6) into multiple beam expanders 241–246. The laser light, after being expanded in diameter, continues from the beam expanders along paths 251–256 until they reach individual shutters 261–266.

Each of the shutters 261–266 is actuated by an electrical signal that runs along control cables 291–296. These electrical signals are generated by sequencer 202 and determine the order and timing of opening and closing of each of shutters 261–266. If remote smoke detector 88 has been placed in its alarm condition, then it is calling for the laser light sequencing to be from left-to-right, and sequencer 202 will energize the shutters in the order of 261, 262, 263, 264, 265, and 266. On the other hand, if remote smoke detector 86 is placed to an alarm condition, then sequencer 202 will have the shutters 261–266 operate in the opposite sequence. When an individual shutter opens (e.g., shutter 261) a laser light beam will travel through the opening of the shutter and through a ceiling lens (e.g., lens 271). The laser light will continue to flow downward from ceiling 18 to floor 20 along a final output beam path 281. As described above, laser light will sequence through each of these ceiling lenses 271–276 along final output beam paths 281–286.

As related above, the use of shutters 261–266 allows laser diodes 211–216 to be energized at all times, thereby eliminating any operational problems due to a long warm-up time required by some laser diodes. For laser diodes that require no warm-up time, the use of shutters 261–266 would not be required. In such an instance, common power cable 206 would comprise a multiple set of control wires which individually run from each of the laser diodes 211–216 back to sequencer 202, via cables 221–226. In this instance, each of laser diodes 211–216 would be individually energized at the proper moment to produce the right-to-left or left-to-right sequence, as required by laser light fire evacuation system 200.

Figure 6:
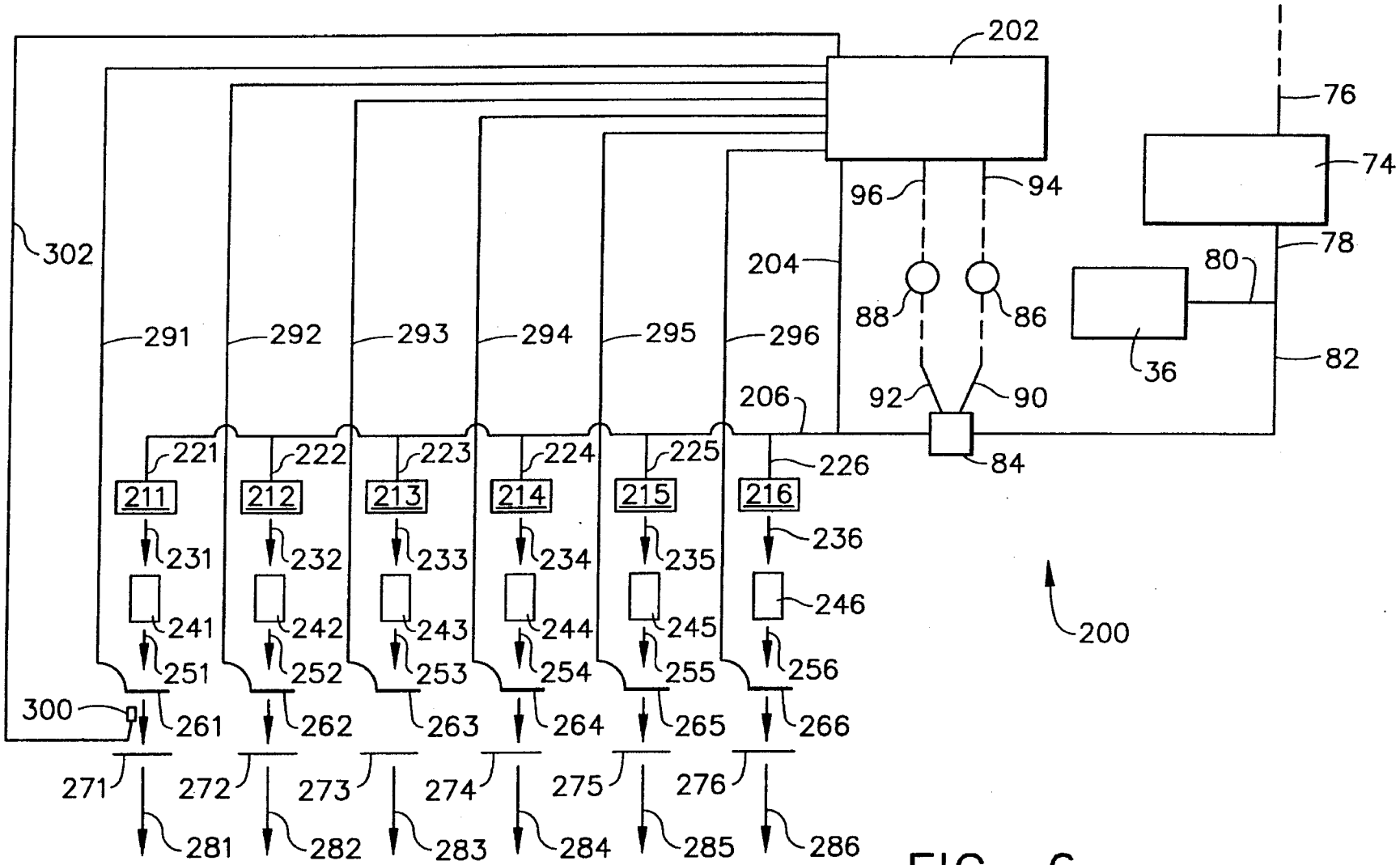
FIG. 6 is a diagrammatic view of a laser light fire evacuation system that uses an electronic sequencer and electrical cables to carry signals throughout the ceiling spaces of a hallway to a plurality of laser diodes which are aimed toward the floor from the ceiling spaces, and is constructed in accordance with the principles of the present invention.

In the illustrated embodiment of FIG. 6, it may be desirable to detect whether or not a particular shutter 261–266 happens to become stuck in its open position. This detection can be accomplished by use of a photodiode 300 which would be placed within the beam diameter of the laser light path after it travels through the open shutter. When laser light strikes photodiode 300, it produces an electrical signal which travels along control cable 302 back to sequencer 202. In a situation where a shutter has been stuck open, it may be desirable to deenergize the particular laser diode 211–216 that is generating the light beam that is traveling through that open shutter. This would particularly be true in a situation where the continuous laser light intensity is greater than the permissible exposure limits (P.E.L.) for safety of human eyes. A similar photodiode could be installed at the exit of each of the shutters 261–266, and each photodiode would have a similar individual control cable to bring its signal back to sequencer 202.

The sequencing timing, separation between columns of light, and beam diameters for laser light fire evacuation system 200 are similar as compared to the requirements for the two other previously described embodiments of the present invention. The use of electronic sequencer 202, however, allows the timing of overlap or non-overlap between adjacent columns of laser light to be precisely controlled. It is still preferred that each laser light path 281–286 be energized for approximately one-quarter of a second, however, a very small overlapping time interval between adjacent beams may be desirable so that a person in the affected hallway or corridor 12 would always be able to see at least one light beam at any particular instant of time. In addition, sequencer 202 makes it possible for there to be zero time gap between energization of the "last" sequenced column of light, and energization of the "first" column of light, as the sequence restarts. In fact, there could still be some overlap between these two columns of light (light columns 281 and 286 on FIG. 6, for example).

Laser light fire evacuation system 200 is intended for complex corridor layouts with turns and bends in the path of egress, long egress paths, and multiple story buildings where large numbers of ceiling devices are required to provide coverage of the egress areas. Since laser diodes are used in this embodiment rather than gas-type lasers (such as the helium-neon lasers used in embodiments 10 and 140), laser light fire evacuation system 200 should be used in lower ceiling areas in the range of eight feet (244 cm) to twelve feet (366 cm), and not in high bay areas. In addition, the amount of beam expansion (enlarged diameter due to the beam expanders) is relatively limited to maintain the intensity being emanated by each of laser diodes 211–216.

It will be understood that a laser light source that emits electromagnetic radiation in the non-visible spectrum could be used in the present invention so long as the radiation is converted into a visible spectrum before reaching hallway or corridor 12. This could be accomplished by use of an ultraviolet light source having its output light beam(s) directed through a fluorescent material, which would then emanate visible light. Since the fluorescent material may not emanate collimated light, such light beam(s) may need to be directed through a beam collimator before being directed into hallway or corridor 12. One reason for constructing a laser light fire evacuation system in this manner would be to achieve a light source of greater output power, since non-visible laser light sources may be more powerful than corresponding visible laser light sources.

It will be further understood that, for a particular building or other field application using a laser light fire evacuation system, it may be desirable to continuously cycle the beam sequencing of the laser beams within a hall or corridor, even when there is no active fire or smoke alarm. In such a circumstance, the laser light fire evacuation system would be not at the mercy of any smoke or temperature detector to initiate its operation. Such a design would be particularly effective for a laser light fire evacuation system that had no moving pans, such as in the third embodiment depicted by index numeral 200.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A fire evacuation system comprising:

(a) an electromagnetic light source emitting radiation in the visible spectrum, said radiation being substantially coherent, said radiation forming a first beam in a predetermined direction;

(b) a beam distribution assembly which receives said first beam of radiation and sequentially diverts said first beam into a plurality of directions, thereby creating a plurality of second beams, each of said second beams having a separate direction;

(c) a plurality of light-guiding members which receive said plurality of second beams, each of said light-guiding members redirecting one of said second beams so as to transit the distance through a building space, thereby creating a plurality of third beams; and (d) a controller to initiate the emission of said plurality of third beams upon the occurrence of an alarm condition, said third beams becoming greater in perceived intensity as the smoke density becomes greater within said building space, said third beams sequencing on and off so as to indicate the correct direction to an exit.

2. The fire evacuation system as recited in claim 1, wherein said electromagnetic light source comprises a laser light source.

3. The fire evacuation system as recited in claim 1, wherein said beam distribution assembly comprises a rotatable table having an angled mirror at its center, said predetermined direction of the first beam being substantially perpendicular to the plane of said rotatable table and directed onto said mirror, said mirror diverting said first beam by about 90° into a second direction substantially parallel to the plane of said rotatable table.

4. The fire evacuation system as recited in claim 3, wherein said controller commands said rotatable table to rotate in one of either a clockwise direction and a counterclockwise direction.

5. The fire evacuation system as recited in claim 3, wherein said rotatable table is driven and rotates in one of a clockwise and counterclockwise direction, said second direction of the beam rotating 360° about an axis which is substantially perpendicular to the plane of said rotatable table, and said axis passing through said mirror.

6. The fire evacuation system as recited in claim 1, wherein said plurality of light-guiding members comprises a plurality of fiber optic cables, each of said fiber optic cables periodically receiving at the cable's input end one of said plurality of second beams and redirecting it so as to become one of said plurality of third beams at the cable's output end.

7. The fire evacuation system as recited in claim 1, wherein said plurality of light-guiding members comprises a plurality of mirrors, each of said plurality of mirrors periodically receiving one of said plurality of second beams and redirecting it so as to become one of said plurality of third beams.

8. The fire evacuation system as recited in claim 1, wherein said controller commands said plurality of third beams to sequence in one of either a left-to-right direction and a right-to-left direction.

9. The fire evacuation system as recited in claim 1, wherein said plurality of third beams travel through said building space in a substantially vertical direction between its floor and ceiling.

10. The fire evacuation system as recited in claim 1, wherein the perceived intensity, as the smoke density becomes greater within said building space, of any one of said plurality of third beams becomes greater to an observer who is not within the beam path of that particular beam.

11. A method for indicating the direction for exiting a building space during a fire emergency, said method comprising the, steps of:

(a) transmitting electromagnetic radiation in the visible spectrum in the form of a plurality of columns, said radiation being substantially coherent, said plurality of columns extending through a building space, said columns becoming greater in perceived intensity as the smoke density becomes greater within said building space, and said columns sequencing on and off so as to indicate the correct direction to an exit;

(b) emitting radiation in the visible spectrum from an electromagnetic light source, thereby forming a first column of light in a predetermined direction;

(c) diverting said first column of light into a plurality of directions, thereby creating a plurality of second columns of light, each of said second columns of light having a separate direction into one of a plurality of light-guiding members; and (d) guiding, via said plurality of light-guiding members, said plurality of second columns of light into paths which are substantially vertical so as to transit the distance between the floor and ceiling of said building space, thereby creating said plurality of columns.

12. The method as recited in claim 11, further comprising expanding each of said plurality of columns, and periodically blocking with a shutter each of said columns so as to sequence the columns on and off to indicate the correct direction to an exit.

13. The method as recited in claim 12, further comprising a light sensor at the output side of each said shutter so as to detect a failed shutter.

14. The method as recited in claim 12, wherein said plurality of columns travel through said building space in a substantially vertical direction between its floor and ceiling.

15. The method as recited in claim 12, wherein the perceived intensity, as the smoke density becomes greater within said building space, of any one of said plurality of columns becomes greater to an observer who is not within the beam path of that particular column.

16. The method as recited in claim 12, wherein the configuration of said plurality of columns causes sequenced columns of visible light to be spaced along said building space such that a person attempting to escape the building space is aided and directed along the entire path of the building space in the correct direction to escape to said exit.

* * * * *

UNITED STATES PATENT AND TRADEMARK OFFICE

CERTIFICATE OF CORRECTION

PATENT NO. : 5,572,183

DATED : November 5, 1996

INVENTOR(S) : Gary L. Sweeney

It is certified that error appears in the above-indentified patent and that said Letters Patent is hereby corrected as shown below:

Column 14, line 37 (claim 11), "the, steps" should read --the steps--.

Column 15, line 1 (claim 14), "12," should read --11,--.

Column 15, line 4 (claim 15), "12," should read --11,--.

Column 16, line 1 (claim 16), "12," should read --11,--.

Signed and Sealed this

Eighteenth Day of February, 1997

*Attest:*

*Attesting Officer*

BRUCE LEHMAN

*Commissioner of Patents and Trademarks*